US005399937A

United States Patent [19]

Greninger

[11] Patent Number: 5,399,937

[45] Date of Patent: Mar. 21, 1995

[54] STARFISH BUNCHED ELECTRON BEAM CONVERTER

[75] Inventor: Paul T. Greninger, Rancho Cucamonga, Calif.

[73] Assignee: Hughes Missile Systems Company, Los Angeles, Calif.

[21] Appl. No.: 68,035

[22] Filed: May 28, 1993

[51] Int. Cl.[6] ..... H01J 23/40; H01P 1/16

[52] U.S. Cl. ..... 315/5; 315/5.51; 333/21 R; 333/125

[58] Field of Search ..... 333/125, 137, 21 R, 333/136; 315/4, 5, 5.51; 331/79

[56] References Cited

U.S. PATENT DOCUMENTS 4,282,458 8/1981 Barnett ..... 315/4
4,604,551 8/1986 Moeller ..... 315/4
5,015,914 5/1991 Ives et al. ..... 315/5 X
5,280,216 1/1994 Mourier ..... 333/137 X

FOREIGN PATENT DOCUMENTS 300605 12/1988 Japan ..... 333/137

*Primary Examiner*—Benny T. Lee
*Attorney, Agent, or Firm*—Charles D. Brown; Randall M. Heald; Wanda K. Denson-Low

[57] ABSTRACT

A modulated bunched electron beam incident on the inner conductor 16 of a coaxial structure launches TEM waves that are distributed to multiple radial waveguides 22 around the outer conductor 14 of the coaxial structure. A tuning piston 32 may be moved axially within the outer conductor for matching the impedance of the coaxial structure to the waveguide array.

20 Claims, 2 Drawing Sheets

STARFISH BUNCHED ELECTRON BEAM CONVERTER

BACKGROUND OF THE INVENTION

The present invention relates to an apparatus for converting the kinetic energy in a bunched electron beam into radio frequency (RF) energy and distributing the RF energy to multiple waveguides.

Practitioners have produced high power (multi-gigawatt) RF generators that convert an Intense Relativistic Electron Beam (IREB) into RF energy. U.S. Pat. No. 3,354,348 issued to Van Iperen discloses a generator that directs an electron beam into a resonant cavity. U.S. Pat. No. 4,345,220 issued to Sullivan discloses a virtual cathode generator that produces transverse magnetic (TM) waves, which propagate through a hollow waveguide towards an output horn.

Practitioners have produced high-power RF energy by directing an IREB upon the center conductor of a coaxial waveguide structure, as discussed in Friedman et al., *Operation of a Multigigawatt Relativistic Klystron Amplifier*, SPIE, vol. 1061, pp. 34–47, 1989, and Friedman et al., *Generation of a High-Power RF Pulse in a Rectangular Waveguide*, Rev. Sci. Instrum., vol. 58, pp. 58–59, January 1987. The excitation of the center conductor by the IREB launches transverse electric and magnetic (TEM) waves. In the electron beam converters disclosed by Friedman et al., the TEM waves propagate along the coaxial structure toward a horn, where they are radiated.

However, such high power converters cannot efficiently be used to feed radar antennas because they could produce more power than a typical waveguide can extract. The maximum power that a waveguide can transmit is limited by the voltage breakdown capabilities of the metallic walls of the waveguide in a vacuum. This maximum power can be calculated using well-known formulas and may be about 60 megawatts (MW) for a standard WR-137 waveguide containing a signal having a maximum electric field of $1.5\times10^7$ V/m at a frequency of 6 gigahertz (GHz). Thus, multi-gigawatt electron beam converters, such as those disclosed by Friedman et al., typically comprise a horn for radiating the RF energy almost immediately after conversion and are not connected to standard waveguides. The power that can be extracted from such electron beam converters is further described in Buschauer, *RF Power Calculations for the NRL Buncher/Converter Microwave Generator*, Rev. Sci. Instrum., vol. 60., pp. 752–753, April 1989.

Antenna arrays, such as those in phased-array radar systems, commonly have multiple RF inputs. The inputs may receive RF energy distributed through a branching waveguide arrangement connected to a single conventional RF generator, such as low-power klystron. A branching waveguide arrangement is disclosed in U.S. Pat. No. 2,445,895 issued to Tyrell. However, the relatively low power produced by conventional RF generators limits their use to feeding single antennas or small antenna arrays.

It would be desirable to generate high power RF energy and efficiently distribute it among multiple waveguides, which could feed large antenna arrays. These problems and deficiencies are clearly felt in the art and are solved by the present invention in the manner described below.

SUMMARY OF THE INVENTION

The present invention comprises an evacuated coaxial structure in which an IREB incident on the inner conductor at one end of the structure launches TEM waves along the inner conductor that are distributed to at least one radial waveguide array at the other end of the structure.

At the input end of the coaxial structure, a drift tube receives a modulated electron beam which contains bunches in the electron distribution as it exits the tube. The bunched electron beam impinges upon the inner conductor, launching TEM waves. The TEM waves propagate along the coaxial structure towards the radial waveguide array at the output end of the structure. The radial waveguide array has two or more waveguides that lie in a plane, in a spoke-like arrangement. One end of each waveguide is connected to the outer conductor for receiving the RF energy. The radial waveguides may transmit the RF energy to a phased array radar or other device. In embodiments having more than one radial waveguide array, the arrays may be distributed along the outer conductor spaced at integer multiples of a half-wavelength.

The output end of the outer conductor may have a larger diameter than the input end to accommodate the adjacent ends of the desired number of waveguides. In addition, the output end of the inner conductor may have a larger diameter than the input end to match the impedance of the coaxial structure to that of the radial waveguide array. The present invention may also comprise a tuning piston at the output end of the structure to provide a finer degree of impedance matching.

The foregoing, together with other features and advantages of the present invention, will become more apparent when referring to the following specification, claims, and accompanying drawings.

BRIEF DESCRIPTION OF THE DRAWINGS

For a more complete understanding of our invention, reference is made to the following detailed description of the embodiments illustrated in the accompanying drawings, wherein.

DESCRIPTION OF THE PREFERRED EMBODIMENT

Figure 1:
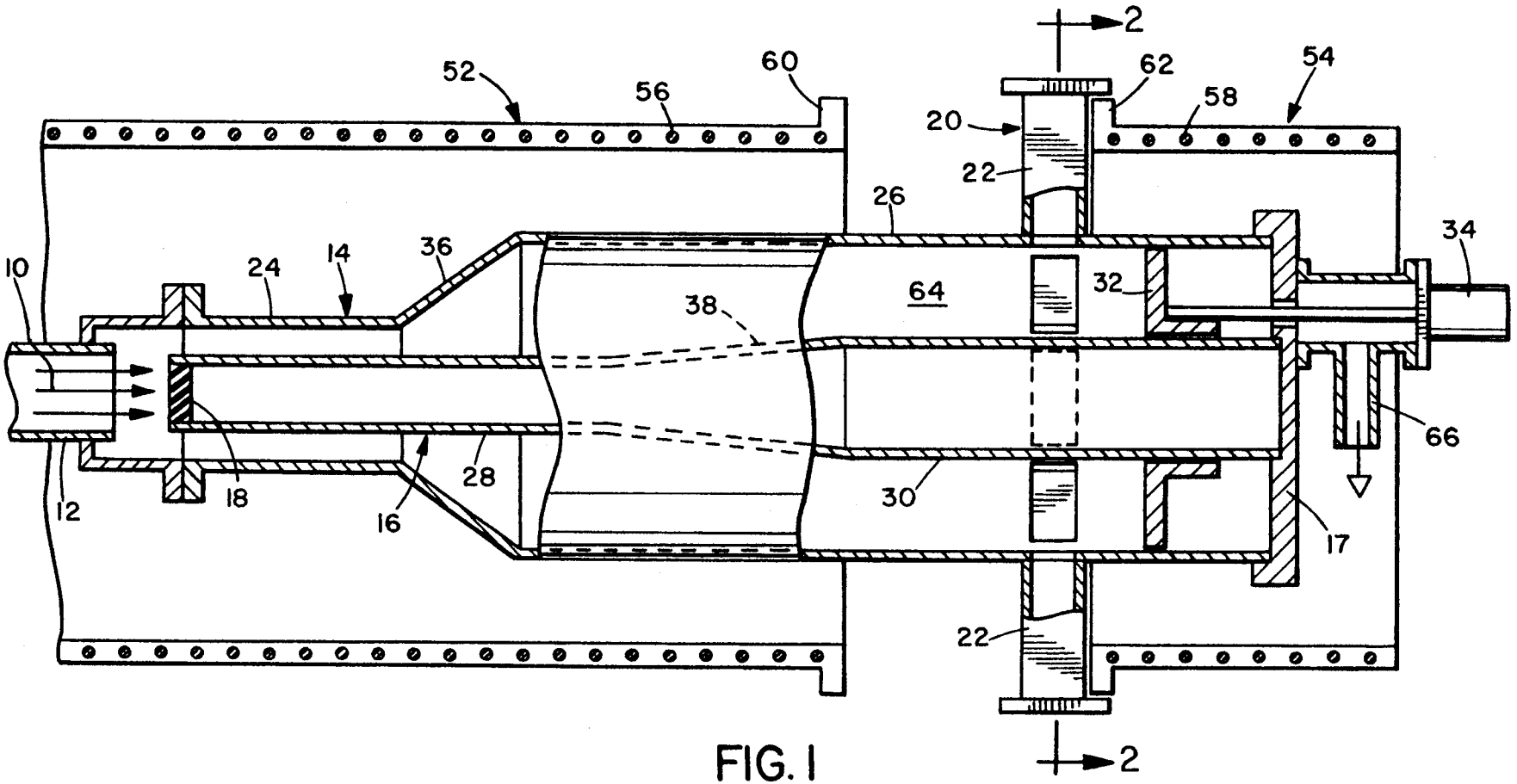
FIG. 1 is a side elevation view, with portions cut away, of the electron beam converter structure.

As shown in FIG. 1, an electron beam generator, such as a relativistic klystron (not shown), emits an electron beam that is modulated by an alternating field. The modulation alternately increases and decreases the velocity of electrons in the beam as they pass through the field. The beam enters a drift tube 12 at one end (not shown). The beam is not modulated by any field in drift tube 12. The length of drift tube 12 is selected to promote bunching of the electrons as they exit drift tube 12, as known in the art.

As shown in FIG. 1, the other end of drift tube 12 is connected to a hollow tubular outer conductor 14. An inner conductor 16 is disposed coaxially within outer conductor 14. Inner conductor 16 may also be hollow. An endcap 17 connected to one end of outer conductor 14 covers the output end of the coaxial structure defined by outer conductor 14 and inner conductor 16. The entire coaxial structure is evacuated, as described below.

The bunched electron beam 10 exits drift tube 12 and strikes a carbon cap 18 disposed on the end of inner conductor 16. The excitation of inner conductor 16 launches TEM waves, which propagate along the coaxial structure. Carbon cap 18 is preferred because it reduces damage to inner conductor 16, thereby increasing its useful life. However, beam 10 may strike any conductive surface at the end of inner conductor 16 that is electrically connected to inner conductor 16. Carbon cap 18 is mounted on the end of inner conductor 16 using any suitable mounting means that ensures an electrical connection.

Figure 2:
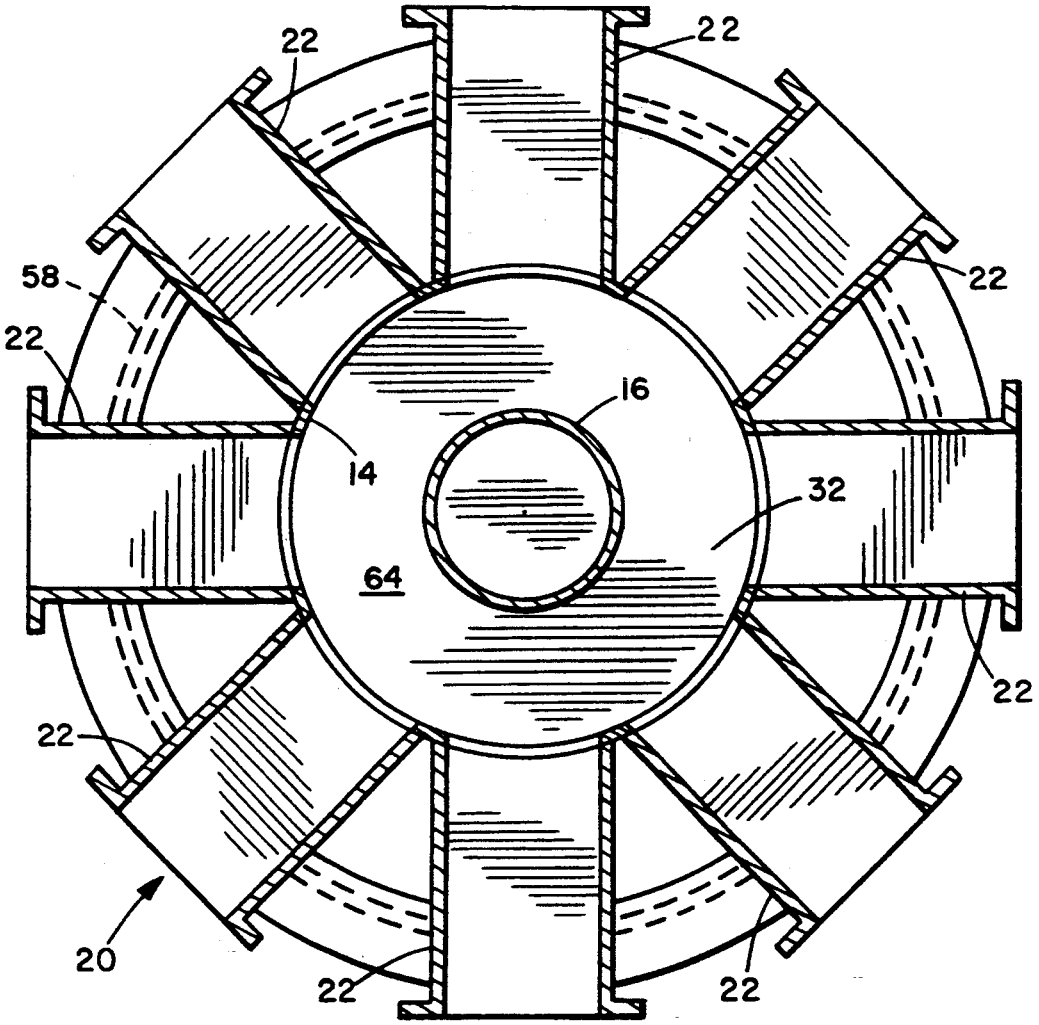
FIG. 2 is an enlarged sectional view taken on line 2—2 of FIG. 1.

As best shown in FIG. 2, a radial waveguide array 20 comprises two or more hollow rectangular waveguides 22, each of which has an end attached to outer conductor 14 and a free end for attaching to an external waveguide (not shown). Waveguides 22 are substantially coplanar, extending away from outer conductor 14 in a spoke-like manner, as shown in FIG. 2. Although eight waveguides 22 are preferred, fewer or more waveguides 22 may be used for reasons discussed below. Although hollow rectangular waveguides 22 are preferred, waveguides 22 may have any suitable shape.

Outer conductor 14 comprises a small-diameter portion 24 and a large-diameter portion 26. Large-diameter portion 26 of outer conductor 14 should be large enough to accommodate the adjacent ends of waveguides 22, which encircle it. Similarly, inner conductor 16 comprises a small-diameter portion 28 and a large-diameter portion 30. The diameter of large-diameter portion 30 of inner conductor 16 should be selected to impedance match the coaxial structure to radial waveguide array 20. The method for selecting diameters for impedance matching such structures is well-known in the art as is not described herein.

A tuning piston 32 is disposed within outer conductor 14 and provides additional adjustment for impedance matching. Tuning piston 32 has a center opening through which center conductor 16 extends. A micrometer adjustment screw 34 mounted on endcap 17 moves piston 32 in an axial direction along inner conductor 16 and outer conductor 14.

The diameters of outer conductor 14 and inner conductor 16 change at frusto-conical transition portions 36 and 38, respectively. Transition portions 36 and 38 are staggered rather than concentric to reduce arcing between inner conductor 16 and outer conductor 14. Arcing is reduced because electrons tend to follow the magnetic flux lines (not shown), which remain parallel to inner conductor 16 along small-diameter portion 28, but begin to curve towards outer conductor 14 at transition portion 38. Thus, arcing is reduced when transition portions 36 and 38 are staggered because the curved flux lines extend a greater distance from the surface of inner conductor 16 before intersecting outer conductor 14. If transition portions 36 and 38 were concentric, arcing would increase because electrons following the curved flux lines away from inner conductor 16 would travel a shorter distance before hitting outer conductor 14.

As discussed above, waveguide array 20 comprises two or more waveguides 22. The extracted power is distributed evenly among waveguides 22. The above-cited Buschauer reference describes the power that a single waveguide can extract from an electron beam converter:

$$P = \frac{I_0^2}{2(\omega C)^2 R} \tag{1}$$

where:

P=power;

$I_O$=modulated beam current (zero to peak);

$\omega=2\pi$ multiplied by the modulation frequency f;

C=stray shunt capacitance; and

R=radiation resistance of the waveguide.

Equation (1) shows that extracted power is maximized when the radiation resistance R of the waveguide is minimized. Equation (1) is applicable to the present invention, although the value of R is equal to the characteristic impedances of all waveguides 22 in waveguide array 20 in parallel. Thus, the present invention minimizes the radiation resistance R when the number of waveguides 22 is maximized.

Figure 3:
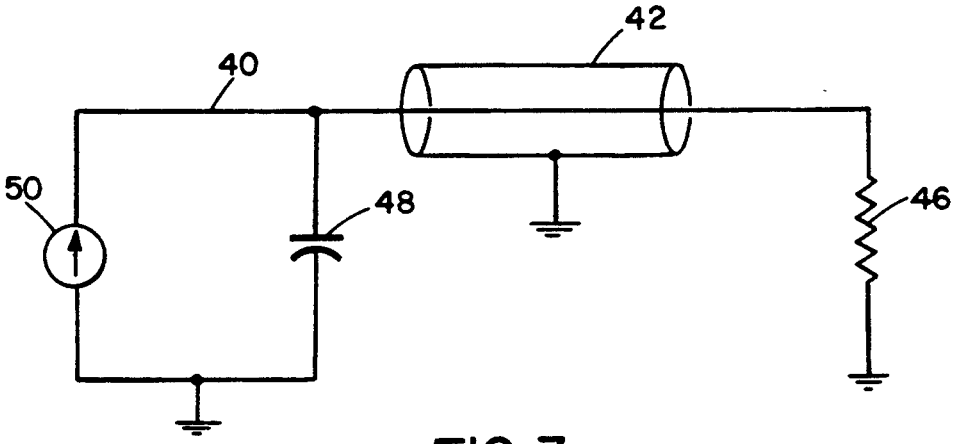
FIG. 3 is a schematic diagram of an equivalent circuit.

The present invention is electrically equivalent to the circuit shown in FIG. 3. In FIG. 3, inner conductor 16 is represented by the wire 40, outer conductor 14 is represented by the coaxial conductor 42, the radiation resistance R is represented by the resistor 46, the stray shunt capacitance C is represented by the capacitor 48, and the modulated beam current $I_O$ is represented by a constant current source 50.

Although power is maximized when the radiation resistance R is a minimum, the following constraint imposes a lower limit on R:

$$R \geqq \frac{I_0}{V_{in}(\omega C)^2} \tag{2}$$

where $V_{in}$ is the input voltage of the converter.

This constraint arises because/modulated beam current $I_O$ produced by a beam generator such as a relativistic klystron can only be assumed to remain constant when the beam generator operates within the constraint. If the constraint of equation (2) were violated the input voltage $V_{in}$ theoretically would exceed the accelerating voltage between the anode and cathode of the electron beam source.

The power that a single waveguide can extract from an electron beam converter is maximized when the value on the left hand side of equation (2) is equal to the expression on the right hand side of equation (2). Equation (2) shows that the presence of stray shunt capacitance between inner conductor 16 and waveguide array 20 imposes a lower limit on R and thus an upper limit on the number of waveguides 22 that are theoretically needed to extract all of the power.

This upper limit is not intended to limit the number of waveguides 22 within the scope of the present invention, but is only provided to illustrate the effect of stray capacitance on power extraction. Although a larger number of waveguides 22 would not extract additional power, a larger number of waveguides 22 may be desirable for other reasons, such as to feed a larger antenna array (not shown). Similarly, a smaller number of waveguides 22 than the number indicated by the above equations may actually extract substantially all of the power because mode competition and other undesirable effects may reduce the efficiency of the present invention below 100 percent.

The stray capacitance of waveguide structures cannot easily be measured because the frequencies involved are extremely high, which prevents the use of common measurement devices such as capacitance bridges. However, the stray capacitance can be derived empirically from equation (2) using an embodiment of the present invention having a convenient number of waveguides 22, such as eight or sixteen, and measuring the modulated beam current and the input voltage. The stray capacitance is typically less than one picofarad.

The maximum number of waveguides 22 needed to extract all of the power can be determined by dividing the characteristic impedance of a waveguide 22 by the radiation resistance of waveguide array 20 when waveguides 22 are identical because waveguides 22 behave electrically as though in parallel. The characteristic impedance, $Z_c$, of a waveguide 22 may be determined by the following equation:

$$Z_c = \frac{\sqrt{\frac{\lambda_0}{\epsilon_0}}}{\sqrt{1 - \left[\frac{\lambda_0}{(2)(b)}\right]^2}} \quad (3)$$

where:

$\mu_O$=permeability of free space ($4\pi \times 10^{-7}$ henrys per meter);

$\epsilon_O$=permittivity of free space (approximately $8.8542 \times 10^{-12}$ farads per meter);

$\lambda_O$=wavelength of modulated beam in air; and b=broad wall cross-sectional dimension of waveguide.

In an exemplary calculation, equation (3) produces a characteristic impedance of 542 Ω, where the modulation frequency is 6 GHz, for a waveguide having a broad wall cross-sectional dimension equal to 3.48 cm. A WR-137 waveguide has a broad wall cross-sectional dimension equal to 3.48 cm and a narrow wall cross-sectional dimension equal to 1.58 cm.

Equation (2) calculates an optimized radiation resistance for waveguide array 20 equal to 33.9 Ω when the modulated beam current is 3.5 kiloamperes (kA), the accelerating voltage is 0.6 megavolts (MV), the modulation frequency is 6 GHz and the stray capacitance is 0.348 picofarads (pF). This characteristic impedance of a waveguide 22 divided by this radiation resistance of waveguide array 20 equals 16. Thus, the maximum number of waveguides 22 needed to extract all the power produced by the present invention under the conditions described in the exemplary calculation is 16. From equation (1), the present invention should produce 1.05 GW of power and evenly distribute it among the 16 waveguides, each waveguide 22 receiving 65.6 MW. Because 65.6 MW may exceed the power transmission capability of many waveguides, it would appear that more than 16 waveguides must be used. However, as discussed above, the present invention may have an efficiency less than 100 percent due to the presence of modes other than TEM. Thus, considerably less power than the theoretical 1.05 GW may actually be available for extraction by waveguides 22. For example, if the efficiency is 50 percent or less, eight or fewer waveguides 22 may be used. As stated above, the preferred number of waveguides 22 in waveguide array 20 is eight.

As shown in FIG. 1, the entire structure must be immersed in a magnetic field to confine the electrons. Electromagnets 52 and 54 comprise wire coils 56 and 58, respectively electromagnets 52 and 54 are concentric with outer conductor 14, as shown, for example, with respect to electromagnet 54 in FIG. 2. Wire coils 56 and 58 are wound on respective cylindrical forms 60 and 62. Any suitable power source (not shown) may be used to energize coils 56 and 58. Permanent magnets may also be used in place of electromagnets 52, 54.

The annular area 64 between inner conductor 14 and outer conductor 16 of the coaxial structure must be evacuated. The structure may be evacuated by any known means. For example, a vacuum pump (not shown) may be connected between the beam generator (not shown) and drift tube 12. As shown in FIG. 1, a vacuum port 66 also provides a means for connecting a vacuum pump, which may withdraw air from annular area 64 through holes (not shown) in piston 32 (see FIGS. 1 and 2).

Obviously, other embodiments and modifications of the present invention will occur readily to those of ordinary skill in the art in view of these teachings. Therefore, this invention is to be limited only by the following claims, which include all such other embodiments and modifications when viewed in conjunction with the above specification and accompanying drawings.

I claim:

1. A converter apparatus for converting kinetic energy of an electron beam into radio frequency (RF) energy, comprising:

a drift tube for bunching said electron bream;

a tubular outer conductor disposed along an axis, said tubular outer conductor having a first end connected to said drift tube for receiving said bunched electron beam, and a closed second end;

a tubular inner conductor disposed coaxially within said outer conductor, said inner conductor spaced from said outer conductor, said inner conductor having a first end for receiving said bunched electron beam and a second end; and a plurality of coplanar waveguides extending in radial directions with respect to said axis of said outer conductor and disposed between said first and second ends of said inner conductor, each waveguide of said plurality of coplanar waveguides having a waveguide end connected to said outer conductor and a waveguide opening at each said waveguide end.

2. The converter apparatus described in claim 1, wherein:

said inner conductor comprises a first portion having a first diameter, a second portion having a second diameter larger than said first diameter of said first portion of said inner conductor, and a frusto-conical transition portion connecting said first and second portions of said inner conductor; and said outer conductor comprises a first portion having a first diameter, a second portion having a second diameter larger than said first diameter of said first portion of said outer conductor, and a frusto-conical transition portion connecting said first and second portions of said outer conductor.

3. The converter apparatus described in claim 2, wherein said transition portion of said inner conductor is located between said transition portion of said outer conductor and said plurality of coplanar waveguides.

4. The converter apparatus described in claim 3, further comprising an axially movable tuning piston disposed within said outer conductor between said plurality of coplanar waveguides and said second end of said outer conductor.

5. The converter apparatus described in claim 4, wherein said plurality of coplanar waveguides comprises eight waveguides.

6. The converter apparatus described in claim 4, wherein said tuning piston comprises a micrometer for manually moving said piston axially.

7. The converter apparatus described in claim 6, wherein said micrometer is mounted on said second end of said outer conductor.

8. The converter apparatus described in claim 7, wherein said tuning piston has an inner opening for slidably engaging said inner conductor.

9. The converter apparatus described in claim 1, further comprising a cap attached to said first end of said inner conductor for receiving said bunched electron beam.

10. The converter apparatus described in claim 9, wherein said cap comprises carbon.

11. The converter apparatus described in claim 10, wherein each waveguide of said plurality of coplanar waveguides has a rectangular cross-section.

12. The converter apparatus described in claim 11, wherein:

said inner conductor comprises a first portion having a first diameter, a second portion having a second diameter larger than said first diameter of said first portion of said inner conductor, and a frusto-conical transition portion connecting said first and second portions of said inner conductor; and said outer conductor comprises a first portion having a first diameter, a second portion having a second diameter larger than said first diameter of said first portion of said outer conductor, and a frusto-conical transition portion between said first and second portions of said outer conductor.

13. The converter apparatus described in claim 12, wherein said transition portion of said inner conductor is located between said transition portion of said outer conductor and said plurality of coplanar waveguides.

14. The converter apparatus described in claim 13, wherein said plurality of coplanar waveguides comprises eight waveguides.

15. The converter apparatus described in claim 14, further comprising at least one magnet disposed concentrically around said outer conductor.

16. The converter apparatus described in claim 15, further comprising a vacuum port communicating with a space between said inner conductor and said outer conductor for removing air from within said outer conductor.

17. A converter apparatus for converting kinetic energy of a modulated electron beam into radio frequency (RF) energy, comprising:

a drift tube for bunching said electron beam;

a coaxial structure for receiving said bunched electron beam and for launching TEM waves, said coaxial structure comprising a tubular outer conductor and an inner conductor, said outer conductor disposed along an axis, said outer conductor having a first end connected to said drift tube and a closed second end, said inner conductor disposed coaxially within said outer conductor, said inner conductor spaced from said outer conductor and having a first end and a second end; and at least one waveguide array connected to said outer conductor for receiving said TEM waves.

18. The converter apparatus described in claim 17, wherein said radial waveguide array comprises at least eight coplanar waveguides extending in radial directions with respect to said axis of said outer conductor, each waveguide of said radial waveguide array having a waveguide end connected to said outer conductor and a waveguide opening at each said waveguide end.

19. The converter apparatus described in claim 18, further comprising at least one magnet comprising a coil of wire disposed concentrically around said outer conductor.

20. The converter apparatus described in claim 19, further comprising an axially movable tuning piston disposed within said outer conductor between said radial waveguide array and said second end of said outer conductor.

* * * * *